US011905951B2

(12) United States Patent
Gutberlet et al.

(10) Patent No.: US 11,905,951 B2
(45) Date of Patent: Feb. 20, 2024

(54) SCROLL COMPRESSOR AND PROCESS FOR COMPRESSING A GASEOUS FLUID WITH THE SCROLL COMPRESSOR

(71) Applicant: Hanon Systems, Daejeon (KR)

(72) Inventors: Dirk Gutberlet, Würselen (DE); Kadir Dursun, Hürth (DE); Michael Friedl, Pulheim (DE)

(73) Assignee: HANON SYSTEMS, Daejeon (KR)

( * ) Notice: Subject to any disclaimer, the term of this patent is extended or adjusted under 35 U.S.C. 154(b) by 143 days.

(21) Appl. No.: 17/431,676

(22) PCT Filed: Apr. 6, 2020

(86) PCT No.: PCT/KR2020/004632
§ 371 (c)(1),
(2) Date: Aug. 17, 2021

(87) PCT Pub. No.: WO2020/242038
PCT Pub. Date: Dec. 3, 2020

(65) Prior Publication Data

US 2022/0120275 A1 Apr. 21, 2022

(30) Foreign Application Priority Data

May 29, 2019 (DE) ..... 10 2019 114 481.7

(51) Int. Cl.
*F04C 18/02* (2006.01)

(52) U.S. Cl.
CPC ..... *F04C 18/0215* (2013.01); *F04C 2240/10* (2013.01)

(58) Field of Classification Search
CPC ..... F04C 18/0215; F04C 18/0246; F04C 18/0269; F04C 2240/10
See application file for complete search history.

(56) References Cited

U.S. PATENT DOCUMENTS 6,345,967 B1 * 2/2002 Mukai ..... F04C 18/0269 418/55.2
6,672,851 B2 1/2004 Ito et al.

FOREIGN PATENT DOCUMENTS

| | | | | |
|---|---|---|---|---|
| CN | 1673542 A | | 9/2005 | |
| CN | 106837796 A | | 6/2017 | |
| CN | 107939681 A | | 4/2018 | |
| JP | 2000027775 A | | 1/2000 | |
| JP | 2000110749 A | | 4/2000 | |
| JP | 2005273453 A | * | 10/2005 | ..... F04C 18/0246 |
| JP | 2005273453 A | | 10/2005 | |
| JP | 3711661 B2 | | 11/2005 | |
| JP | 2006037867 A | | 2/2006 | |
| JP | 2009250200 A | | 10/2009 | |

(Continued)

*Primary Examiner* — Anthony Ayala Delgado
(74) *Attorney, Agent, or Firm* — Shumaker, Loop & Kendrick, LLP; James D. Miller

(57) ABSTRACT

A scroll compressor for compressing a gaseous fluid, in particular a refrigerant. The scroll compressor exhibits a non-moving stator with at least one outlet and a moving orbiter, each with a base plate and a spiral-shaped wall that extends from the base plate. The base plates are arranged relative to one another in such a way that the walls interlock with one another and closed working chambers are created. The volumes and the positions of the working chambers are changed in reaction to a rotary movement of the orbiter here.

17 Claims, 5 Drawing Sheets

(56) References Cited

FOREIGN PATENT DOCUMENTS

| | | | |
|---|---|---|---|
| JP | 2015038333 | A | 2/2015 |
| KR | 20060048832 | A | 5/2006 |

* cited by examiner

SCROLL COMPRESSOR AND PROCESS FOR COMPRESSING A GASEOUS FLUID WITH THE SCROLL COMPRESSOR

CROSS-REFERENCE TO RELATED PATENT APPLICATIONS

This patent application is a United States national phase patent application based on PCT/KR2020/004632 filed on Apr. 6, 2020, which claims the benefit of German Patent Application No. DE 10 2019 114 481.7 filed on May 29, 2019, the entire contents of both of which are hereby incorporated herein by reference.

TECHNICAL FIELD

The present invention relates to a scroll compressor as a device for compressing a gaseous fluid, in particular a refrigerant. The device exhibits a non-moving stator with a base plate and wall constructed in a spiral shape that extends from the base plate, as well as at least one outlet and a moving orbiter with a base plate and a wall constructed in a spiral shape that extends from the base plate. The base plates are arranged relative to one another in such a way that the wall of the stator and wall of the orbiter interlock and thereby create closed working chambers. The volumes and positions of the working chambers are changed in reaction to a rotary movement of the orbiter.

The present invention also relates to a process for compressing a gaseous fluid with the scroll compressor.

BACKGROUND ART

Compressors known from the state of the art for mobile applications, in particular as air-conditioning systems in motor vehicles, for conveying refrigerant through a refrigerant circuit, also known as refrigerant compressors, are often constructed as piston compressors with variable displacement or as scroll compressors irrespective of the refrigerant used. The compressors are driven either via a belt pulley or electrically here.

The compression mechanism of a scroll compressor comprises a non-moving, stationary stator with spiral-shaped wall extending from a base plate, as well as a moving orbiter with spiral-shaped wall extending from a base plate. The base plates are arranged relative to one another in such a way that the wall of the stator and wall of the orbiter interlock and thereby create closed working chambers. The stator and the orbiter work together. Here, the moving scroll is moved using an eccentric drive on a circular path in such a way that the spiral-shaped walls touch one another in multiple locations and that multiple consecutive and sealed off working chambers are created between the walls and the base plates. The working chambers arranged next to one another (neighboring chambers) have various volumes. As a result of the movement of the orbiter relative to the stator, the volumes and the positions of the working chambers are changed in such a way that the volumes of the working chambers become increasingly smaller towards the center of the spiral-shaped walls and a gaseous fluid is compressed inside the working chambers. The fluid compressed in this way is released from the compression mechanism through at least one outlet.

It is known from the state of the art to adjust the stator or the orbiter, which are also referred to as non-moving/fixed scrolls or moving scrolls, in such a way as to minimize a dead volume during compression, taking into account the at least one outlet and, in particular, the arrangement and the size of the outlet.

US 2003 0108444 A1 also describes a scroll compressor with a stator and an orbiter, each with spiral-shaped wall. The goal with construction of the one inner and one outer wall surface, each defined by an evolvent curve and exhibiting walls, is to reduce the distance between the two spiral-shaped walls.

DISCLOSURE OF INVENTION

Conventional scroll compressors, in particular the spiral-shaped walls of the stator and orbiter, are constructed in such a way that at the end of the process of compressing of the gaseous fluid a certain working chamber, also referred to as the compression chamber or intermediate chamber, is created in such a way that the pressure of the fluid inside the intermediate chamber during compression can be very high under certain conditions relative to the high pressure in the system or also between two end chambers. The significantly increased pressure of the fluid can cause audible and discernible vibrations and thereby a considerable deterioration in terms of noise, vibration and harshness (NVH behavior).

The object of the invention is to provide a device for compressing a gaseous fluid, in particular a further development of a scroll compressor, with which formation of over-pressure within the intermediate chamber is either reduced or, where applicable, avoided altogether in comparison with the high pressure of the system. In addition to this, an even as possible pressure equalization between the two end chambers of the two compression paths should be facilitated or improved, particularly in the case of non-symmetrical scroll geometries, i.e. especially in the case of geometries with various wrap angles of the compression paths, also to prevent any acceleration of the orbiter. The aim here is to reduce or eliminate the vibrations generated by the compressor and consequently improve the NVH behavior of the compressor. The device should be easy to construct in order to minimize the costs of manufacture and maintenance.

The task is solved by the subject with the characteristics of the independent patent claim. Further embodiments are provided in the dependent patent claims.

The task is solved by a scroll compressor according to the invention as a device for compressing a gaseous fluid, in particular a refrigerant. The device exhibits a nonmoving stator with a base plate and wall constructed in a spiral shape that extends from the base plate of the stator, as well as at least one outlet and a moving orbiter with a base plate and wall constructed in a spiral shape that extends from the base plate of the orbiter. The base plates are arranged relative to one another in such a way here that the wall of the stator and wall of the orbiter interlock and thereby create closed working chambers. The volumes and positions of the working chambers are changed in reaction to a movement, in particular a rotary movement, of the orbiter.

The spiral-shaped walls are configured in such a way that a first end chamber and a second end chamber of a compression path are created in the area of the at least one outlet, as well as an intermediate chamber arranged between the end chambers on inner ends of the walls based on a rotation angle of the orbiter.

As per the conceptual design of the invention, at least one of the spiral-shaped walls in the area of the inner end is constructed in such a way that a gap is opened between the walls as a flow path from the intermediate chamber to at least one end chamber. A degree of opening of the flow path is dependent on the rotation angle of the orbiter here.

As the degree of opening of a flow path, a ratio of the current flow cross-section relative to the maximum possible flow cross-section is understood to mean the free flow area for the fluid in the following.

As per a beneficial embodiment of the invention, the wall of the stator with the inner end on the wall of the orbiter and the wall of the orbiter with the inner end on the wall of the stator are arranged in contact with one another and seal off the intermediate chamber based on the rotation angle of the orbiter.

Depending on the rotation angle of the orbiter, a gap can be created between the walls of the stator and orbiter as a flow path from the intermediate chamber to the first end chamber or as a flow path from the intermediate chamber to the second end chamber. The degrees of opening of the flow paths are dependent on the rotation angle of the orbiter in each case here.

In addition to this, a gap can be created between the walls of the stator and orbiter, based on the rotation angle of the orbiter, as a flow path from the first end chamber to the second end chamber. The degree of opening of the flow path between the end chambers is also dependent on the rotation angle of the orbiter here.

As per a further embodiment of the invention, the at least one wall in the area of the inner end between two sections is constructed with a reduced wall thickness in comparison with a scroll compressor known from the state of the art, so as to increase the volume of the intermediate chamber.

The at least one wall should preferably be constructed in such a way that the thickness of the wall becomes ever smaller from a first section, moving toward the second section, and then increases in the area of the second section back to the initial value at the second section. In comparison with a scroll compressor known from the state of the art, a side of the wall pointing towards the center of the orbiter is constructed with a radial outward offset.

As per a preferred embodiment of the invention, the at least one wall exhibits a constant wall thickness along a height of the wall and thereby also a constant contour.

The height of the wall represents an expansion of the wall in an axial direction here, i.e. towards the rotary axis of the orbiter. As a result, the contour of the wall is identical, primarily in the area of a first face that is connected to the base plate and a second, free face that is aligned in the axial direction as well as distally to the base plate, as well as uniform and constant across the entire height.

Another advantage of the invention lies in the fact that the spiral-shaped wall of the orbiter and/or the spiral-shaped wall of the stator are each is constructed in such a way in the area of the inner end that a gap between the wall of the stator and the wall of the orbiter is opened as a flow path from the intermediate chamber to the at least one end chamber.

The task is also solved by a process according to the invention for compressing a gaseous fluid, in particular a refrigerant, using an aforementioned scroll compressor according to the invention.

As per the conceptual design of the invention, a gap is opened between the spiral-shaped walls of the stator and the orbiter in a certain area of the orbiter's rotation angle in an arrangement of stator and orbiter as a flow path from an intermediate chamber to at least one end chamber of a compression path. The degree of opening of the flow path is dependent on the rotation angle of the orbiter here. The intermediate chamber, and thereby also a possible gap between the walls, is closed with an arrangement of the stator and orbiter at an orbiter rotation angle of 0°.

With the arrangement of stator and orbiter at an orbiter rotation angle of 0°, the intermediate chamber as the final compression chamber is fluidically connected only to the outlet of the stator. There is also no connection to an end chamber via the outlet here.

As per a further embodiment of the invention, the flow path from the intermediate chamber to the at least one end chamber is opened in the orbiter rotation angle range from greater than 0° to 60°.

As per a preferred embodiment of the invention, the gap between the intermediate chamber and an end chamber is opened at an orbiter rotation angle in a range around 20° with an arrangement of the stator and orbiter, wherein the flow path between the intermediate chamber and the end chamber exhibits a degree of opening of around 20%.

As per an advantageous embodiment of the invention, an open gap is created between the intermediate chamber and a first end chamber, as well as between the intermediate chamber and a second end chamber at an orbiter rotation angle in a range around 30° with an arrangement of the stator and orbiter. A flow path between the intermediate chamber and an end chamber exhibits a degree of opening of around 40% here.

Another advantage of the invention lies in the fact that a gap is created between the intermediate chamber and the first end chamber, as well as between the intermediate chamber and the second end chamber at an orbiter rotation angle in a range around 60° with an arrangement of the stator and orbiter in such a way that compressed fluid flows between the end chambers. The flow path between the end chambers preferably exhibits a degree of opening of around 10% here.

As per a further embodiment of the invention, the flow path between the end chambers is continuously open with an arrangement of the stator and orbiter at an orbiter rotation angle in a range greater than 30°, in particular greater than 60°. At an orbiter rotation angle of around 115°, the flow path between the end chambers is completely open.

The device according to the invention for compressing a gaseous fluid, in particular as a further development of a scroll compressor, as well as the process for compressing the gaseous fluid, in particular a refrigerant, using the scroll compressor with integrated, specific, rotation angle-based gap between the scrolls collectively exhibit various other advantages:

- The respective cross-sectional flow area of the gap is designed in such a way that optimum matching of the pressure in the end chambers is guaranteed, wherein the variable inner gap increases the spacing of the scrolls in corresponding sections in comparison with the state of the art in order to secure targeted flow of the fluid between the end chambers,
- Reduction or prevention of overpressure formation inside the intermediate chamber or even and continuous pressure equalization between the two end chambers of the two compression paths, particularly in the case of scrolls formed with different evolvent angles, wherein the characteristic for achieving equal pressure is improved—the pressure equalization between the end chambers is adjusted and controlled based on the rotation angle or the compression cycle time, leading to
- Minimization or avoidance of vibrations and acceleration of the orbiting scroll and improving the NVH behavior of the compressor, simple and affordable manufacture of the device, for example with regard to the coating of the scrolls, in particular of the orbiter, and within a casting process step, wherein a transition is constructed between the wall and the base plate, as well as potentially phases at the inner end of the wall with the remaining scroll geometry, so that neither the tool needs to be changed nor are any further machining steps necessary, meaning that there are, for example, also no risks associated with sharp edges that could occur during separate production of a notch.

BRIEF DESCRIPTION OF DRAWINGS

Further details, features and benefits of embodiments of the invention result from the following description of specimen embodiments with reference to the accompanying drawings. These display the following.

DESCRIPTION OF EMBODIMENTS OF THE INVENTION

Figure 1A:
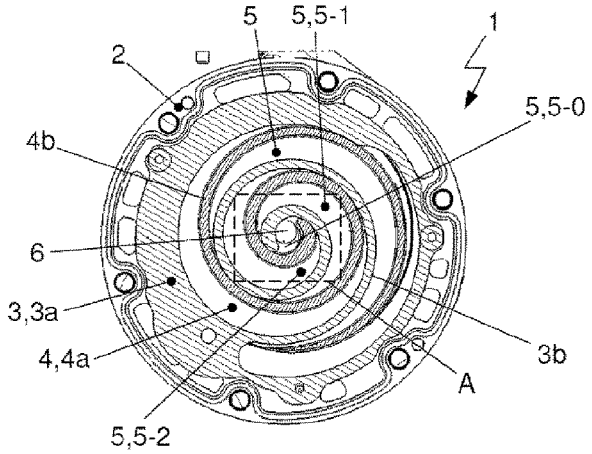
FIGS. 1A and 1B: A scroll compressor as a device for compressing a gaseous fluid using a compression mechanism in a lateral sectional view, as well as a detailed view of a plan view of the compression mechanism.

FIG. 1A shows a lateral sectional view of a scroll compressor 1 as a device for compressing a gaseous fluid using a compression mechanism.

The scroll compressor 1 exhibits a housing 2, a non-moving, fixed stator 3 with a disk-shaped base plate 3*a* and a spiral-shaped wall 3*b* that extends from one side of the base plate 3*a*, as well as a moving orbiter 4 with a disk-shaped base plate 4*a* and a spiral-shaped wall 4*b* that extends from the base plate 4*a*. The stator 3 and orbiter 4 work together and are, in particular, arranged relative to one another with the base plates 3*a*, 4*a* in such a way that the wall 3*b* of the stator 3 and the wall 4*b* of the orbiter 4 interlock with one another.

The orbiter 4, also classed as a moving scroll 4, is moved on a circular path using an eccentric drive and relative to the stator 3, also classed as a fixed scroll 3. The spiral-shaped wall 4*b* revolves around the stationary spiral-shaped wall 3*b*. During the relative movement of the scrolls 3, 4 to one another, the walls 3*b*, 4*b* touch one another in multiple locations and form multiple consecutive, sealed working chambers 5, 5-0, 5-1, 5-2 between the walls 3*b*, 4*b* and the base plates 3*a*, 4*a*, wherein the working chambers arranged next one another 5, 5-0, 5-1, 5-2 (neighboring chambers) display different volumes.

The volumes and the positions of the working chambers 5, 5-0, 5-1, 5-2 change in reaction to the movement of the orbiter 4 relative to the stator 3. The size of the working chambers 5, 5-0, 5-1, 5-2 is reduced due to the counter-rotational movement of the two interlocking, spiral-shaped walls 3*b*, 4*b*. The volumes of the working chambers 5, 5-0, 5-1, 5-2 arranged towards the center of the spiral-shaped walls 3*b*, 4*b*, which are also classed as scroll walls, become smaller. Here, a gaseous fluid enclosed inside the working chambers is compressed and then released from the compression mechanism through an outlet 6 from a first end chamber 5-1 of a first compression path of the scroll compressor 1, as well as from a second end chamber 5-2 of a second compression path of the scroll compressor 1. The gaseous fluid to be compressed, in particular a refrigerant, is drawn in, compressed inside the compression mechanism and then released via an outlet.

The eccentric drive (not shown) exhibits a drive shaft that rotates around a rotary axis and is supported by bearings on the housing 2. The orbiter 4 is eccentrically connected to the drive shaft via an intermediate element. This means that the axes of the orbiter 4 and the drive shaft are arranged with an offset from one another. The orbiter 4 is supported via another bearing on the intermediate element.

Figure 1B:
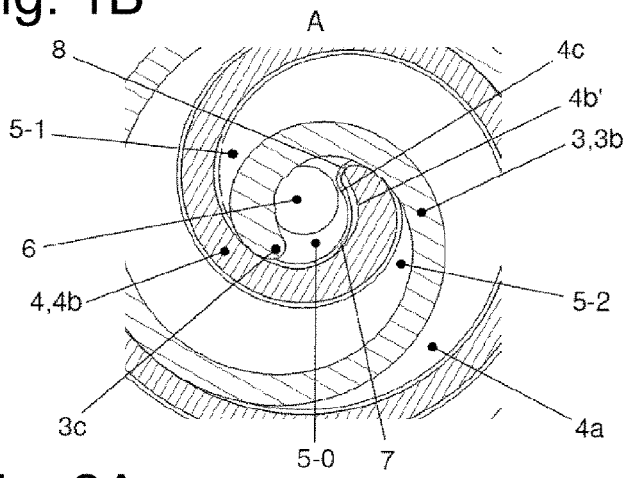
Figure 2A:
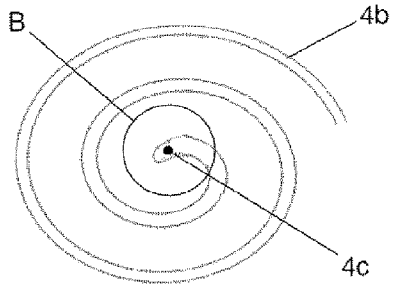
FIGS. 2A to 2C: A spiral-shaped wall of the compression mechanism in a plan view, as well as a detailed view of an inner end of the spiral-shaped wall.
Figure 2B:
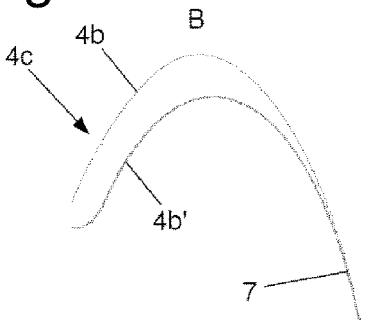
Figure 2C:
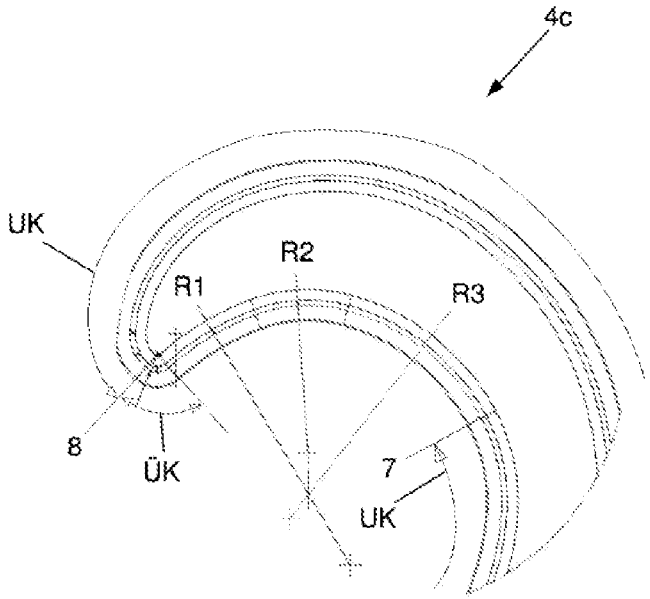

FIG. 1B shows a detailed view A of a plan view of the compression mechanism from FIG. 1*a* in the area of the intermediate chamber 5-0, the end chambers 5-1, 5-2, as well as the outlet 6. FIGS. 2A and 2B show the spiral-shaped wall 4*b* of the orbiter 4 as a single element in a schematic plan view, as well as a detailed view B of an inner end 4*c* of the spiral-shaped wall 4*b*. FIG. 2C shows an inner end 4*c* of an embodiment of a spiral-shaped wall 4*b* of the moving scroll 4. The outlet 6 is constructed as a sealable passage opening in the base plate 3*a* of the stator 3 and, just like the wall 3*b* of the stator 3, is therefore non-moving—also relative to the wall 3*b*.

As a result of the movement of the orbiter 4 along the circular path and relative to the stator 3, the spiral-shaped wall 4*b* revolves around the stationary spiral-shaped wall 3*b*. As per FIG. 1B, the walls 3*b*, 4*b* of the scrolls 3, 4 are each arranged on internal sides in the area of inner ends 3*c*, 4*c*, aligned with one another and in contact with one another. Here, the wall 3*b* of the fixed scroll 3 is in contact with the inner end 3*c* on the wall 4*b* of the moving scroll 4, while the wall 4*b* of the moving scroll 4 is in contact with the inner end 4*c* on the wall 3*b* of the fixed scroll 3, thereby sealing off the intermediate chamber 5-0.

Consequently, the intermediate chamber 5-0 is limited on the one side by the wall 3*b* of the stator 3 and on the other side by the wall 4*b* of the orbiter 4. The walls 3*b*, 4*b* are arranged such that they are in contact with one another in two sections of the inner end 4*c* of the wall 4*b*.

In the area of the inner end 4*c* of the wall 4*b* of the orbiter 4, the wall 4*b* between two sections 7, 8 is constructed with a reduced wall thickness in comparison with a wall 4*b*' of an orbiter as per the state of the art. The wall thicknesses of the walls 4*b*, 4*b*' gradually increases, starting from the first section 7 and moving towards the second section 8. It is then reduced quite sharply in the area of the second section 8, in particular in comparison with the gradual increase. The contour of the wall 4*b* of the orbiter 4 differs from the wall 4*b*' of a conventional orbiter between sections 7, 8. Otherwise, the contours of the walls 4*b*, 4*b*' are primarily constructed identically.

The arrangement of the sections 7, 8 of the wall 4*b* is fixed in each case in such a way that the efficiency of the process of compressing the fluid remains unchanged. Based on a simulation of the movement of the orbiter 4, taking into account the outlet 6 constructed on the stator 3, in particular taking into account the position and size of the outlet 6, a sealing line is determined between the walls 3*b*, 4*b* of the two scrolls 3, 4 in such a way that the intermediate chamber 5-0 is optimally sealed as the final compression chamber, which is necessary for a high efficiency of the process of compressing the fluid, particularly at high pressures. The second section 8 is, in particular, arranged precisely in order to avoid any loss of efficiency during compression.

The radius of the inner side of the wall 4*b* of the orbiter 4 according to the invention is greater than the radius of the inner side of the wall 4*b*' of the orbiter known from the state of the art, meaning that the volume of the intermediate chamber 5-0 of the compression mechanism of the scroll compressor 1 according to the invention is greater than the volume of an intermediate chamber of the compression mechanism of a conventional scroll compressor. The base plates 3*a*, 4*a* of the compression mechanisms that limit the volume of the intermediate chambers 5-0 are also identical.

The area of the inner end 4*c* of the wall 4*b* of the orbiter 4, in particular the inner side of the inner end 4*c*, is preferably defined as a so-called "spline" with more than two radiuses, with freely defined mathematical functions or via reference points and modified.

The contours of the wall 4*b* of the orbiter 4 are identical in the area of a first face connected to the base plate 4*a* and a second, free face that is aligned in the axial direction, as well as distally towards the base plate 4*a*. The faces of the wall 4*b*, each of which is arranged on a plane defined vertically to the axial direction, are consequently the same and also arranged at even spacings from one another. The distance between the faces is classed as the height of the wall 4*b*. The expansion of the wall in the axial direction is therefore viewed as the height of the wall 4*b*. The contour of the wall 4*b* is constant over the entire height of the wall 4*b*.

The wall 4*b* of the orbiter 4, which extends from the first face, itself aligned towards the base plate 4*a* of the orbiter 4, to the second face, which is aligned towards the base plate 3*a* of the stator 3, can be manufactured in a combined process with the other scroll geometry or also within a step-by-step process. Manufacture of the moving scroll 4 can then be performed using a casting tool or cutting tool and forming the base plate 4*a* with the wall 4*b* in one step or within a two-step or multi-step process in separate steps. The contour of the wall 4*b* can also be produced using high-precision turning processes, milling processes or combined turning/milling processes, as well as during rough or precision grinding of the scrolls 4.

Compared to a conventional scroll compressor, the wall 4*b* of the orbiter 4 of the scroll compressor 1 according to the invention is modified in such a way that in certain arrangements of the scrolls 3, 4 to one another, in particular in specific ranges of a rotation angle in which a closed intermediate chamber 5-0 is conventionally constructed, a gap between the walls 3*b*, 4*b* of the scrolls 3, 4 is secured, whose degree of opening is based on the rotation angle of the orbiter 4. The associated degree of opening of a flow path that is dependent on the rotation angle of the orbiter 4 due to the gap can adapted optimally to the corresponding application in each case, in particular the pressure levels in place, the wrap angles of the compression paths, as well as opening geometries within the fixed scroll 3, in particular to avoid any overpressure of the compressed fluid inside the intermediate chamber 5 or to minimize this pressure or secure the most even pressure equalization possible between the two end chambers 5-1, 5-2 of the compression paths of the scroll compressor 1, also to avoid any acceleration of the orbiter 4. Consequently, the space between the scrolls 3, 4 is changed, in particular increased, on the basis of the rotation angle of the orbiter 4 using the variable degree of opening of the gap in order to guarantee a flow for equalization of the pressures of the fluid inside the end chambers 5-1, 5-2 and thereby an equalization flow between the two end chambers 5-1, 5-2. The variable degree of opening of the gap that is based on the rotation angle results from the contours of the spiral-shaped walls 3*b*, 4*b* of the scrolls 3, 4.

With the objective of avoiding pressure spikes due to trapped fluid, as well as avoiding sudden pressure equalization processes, the rotation angle-based contour of the orbiter 4 is calculated, for example using CFD (computational fluid dynamics) simulations. Unchanged contours of the walls 3*b*, 4*b* of the scrolls 3, 4 are used as the starting point for calculation here. During the calculations, at least one of the contours of the walls 3*b*, 4*b* of the scrolls 3, 4 is changed in such a way over an unchanged contour of the walls 3*b*, 4*b* of the scrolls 3, 4 that larger gaps between the walls 3*b*, 4*b* of the scrolls 3, 4 are created during the orbiting movement of the orbiter 4.

The arrangement of the calculated contour of the wall 3*b*, 4*b* is then adjusted, taking into account boundary conditions of manufacturing, such as minimum radiuses that can be produced and possible cutting paths of the tool used.

The final construction of the contour of the wall 3*b*, 4*b*, for example as per FIG. 2C, in particular of the inner end 4*c* of the wall 4*b* of the orbiter 4 with the various radiuses R1, R2, R3, is then based on experimental tests on compressors, taking into account the efficiency of the process of compressing the fluid and the NVH behavior of the compressor. The contour of the wall 4*b* is changed between the two sections 7, 8 relative to a wall 4*b*' of an orbiter as per the state of the art. In each case, the contour corresponds to the unchanged original contour UK up to the sections 7, 8. A transition contour UK is also formed in the area of the second section 8.

FIGS. 3A to 3H use a plan view to show an open or closed gap between the inner ends 3*c*, 4*c* of the spiral-shaped walls 3*b*, 4*b* of the compression mechanism based on the rotation angle of the orbiter 4 relative to the stator 3 and a comparison of a conventional wall 4*b*' with a wall of the orbiter according to the invention 4*b*. FIG. 4A also shows a diagram of the degree of opening of a flow path between the two end chambers 5-1, 5-2 based on the rotation angle of the orbiter 4 relative to the stator 3, while FIG. 4B shows a diagram of the degree of opening of a flow path between the intermediate chamber 5-0 and the first end chamber 5-1 based on the rotation angle of the orbiter 4 relative to the stator 3.

Figure 3A:
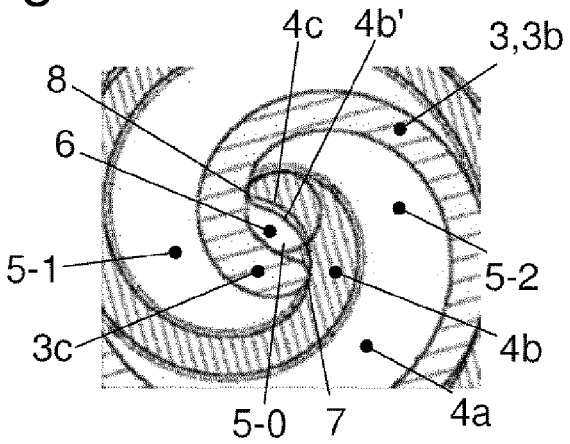
FIGS. 3A to 3H: Gap between the inner ends of the spiral-shaped walls of the compression mechanism based on a rotation angle of an orbiter relative to a stator and comparison of a conventional wall with a wall according to the invention, each in a plan view, as well as FIG. 4A: A diagram of the degree of opening of a flow path between two end chambers based on the rotation angle of the orbiter relative to the stator, as well as FIG. 4B: A diagram of the degree of opening of a flow path between an intermediate chamber and an end chamber based on the rotation angle of the orbiter relative to the stator.
Figure 4A:
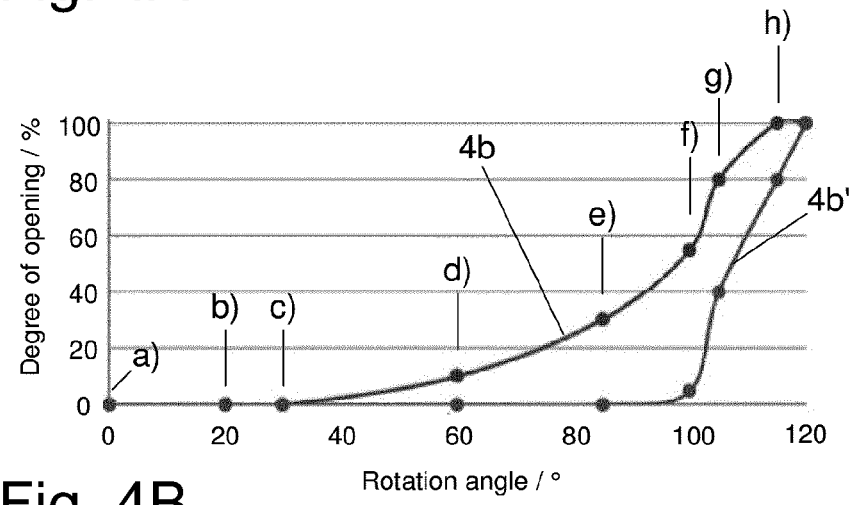
Figure 4B:
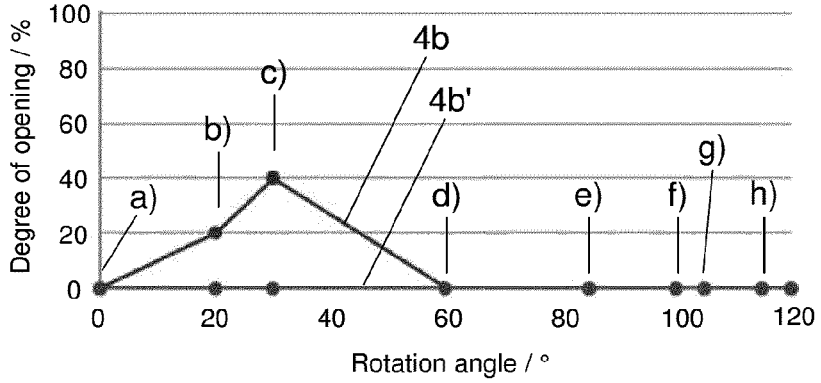

Up to an arrangement of stator 3 and orbiter 4 at a rotation angle of 0° as per FIG. 3A, the scroll compressors 1 display identical compression behavior with a wall according to the invention 4*b* and a conventional wall 4*b*'. In each case here, both the first section 7, as a connection between the intermediate chamber 5-0 and the first end chamber 5-1 of the first compression path, and the second section 8, as a connection between the intermediate chamber 5-0 and the second end chamber 5-2 of the second compression paths, are closed. The sections 7, 8 between the walls 3*b*, 4*b*, 4*b*' of the scrolls 3, 4 are sealed off, so that the degrees of opening of the respective flow paths as per FIGS. 4A and 4B are zero.

Figure 3B:
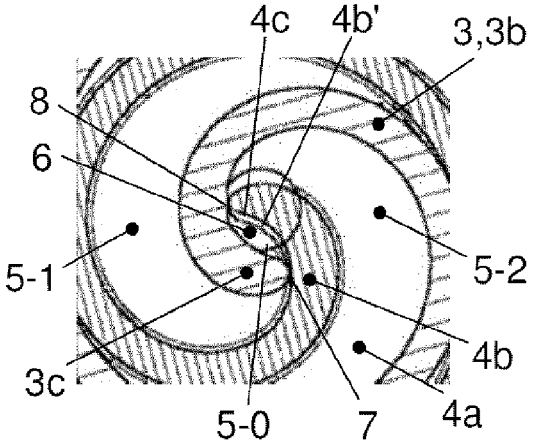

With an arrangement of stator 3 and orbiter 4 at a rotation angle of 20° as per FIG. 3B and construction of the wall according to the invention 4*b*, a gap is open in the area of the first section 7 between the intermediate chamber 5-0 and the first end chamber 5-1 in comparison with the conventional wall 4*b*', so that compressed fluid flows out of the intermediate chamber 5-0 and into the first end chamber 5-1 and thereby reduces or avoids overpressure in the intermediate chamber 5-0. As per FIG. 4B, the flow path between the intermediate chamber 5-0 and the first end chamber 5-1 exhibits a degree of opening of 20%. With construction of the conventional wall 4*b*', the first section 7, as a connection between the intermediate chamber 5-0 and the first end chamber 5-1, is closed.

The second section 8, as a connection between the intermediate chamber 5-0 and the second end chamber 5-2, is closed regardless of the construction of the wall 4*b*, 4*b*' of the orbiter 4, so that the flow paths between the end chambers 5-1, 5-2 are also closed. Since, with construction of the conventional wall 4*b*', both the first section 7 and the second section 8 are closed as connections between the intermediate chamber 5-0 and one of the end chambers 5-1, 5-2, the risk of excessive overpressure inside the intermediate chamber 5-0 is very high.

Figure 3C:
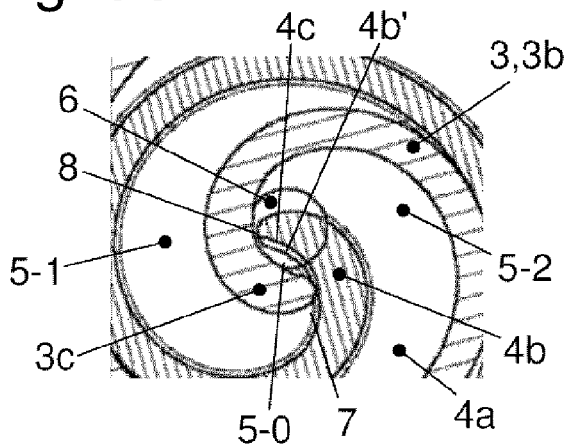

With an arrangement of stator 3 and orbiter 4 at a rotation angle of 30° as per FIG. 3C and construction of the wall according to the invention 4*b*, a gap is formed or a flow path opened both in the area of the first section 7 between the intermediate chamber 5-0 and the first end chamber 5-1 and in the area of the second section 8 between the intermediate chamber 5-0 and the second end chamber 5-2 in comparison with the conventional wall 4*b*', so that compressed fluid flows out of the intermediate chamber 5-0 and into the end chambers 5-1, 5-2 and thereby reduces or avoids overpressure in the intermediate chamber 5-0. As per FIG. 4B, the flow path between the intermediate chamber 5-0 and the first end chamber 5-1 exhibits a degree of opening of 40%. Due to the low degrees of opening of the gaps in the area of the sections 7, 8 and the release of the fluid from the intermediate chamber 5-0 into the respective end chambers 5-1, 5-2 due to the greater pressure of the fluid inside the intermediate chamber 5-0, no fluid flows between the end chambers 5-1, 5-2 themselves, so that the degree of opening of the flow path between the end chambers 5-1, 5-2 as per FIG. 4A is zero.

With the construction of the conventional wall 4*b*', both the first section 7, as a connection between the intermediate chamber 5-0 and the first end chamber 5-1, and the second section 8, as a connection between the intermediate chamber 5-0 and the second end chamber 5-2, are closed, meaning that the flow path between the end chambers 5-1, 5-2 is consequently also closed and additionally that the risk of excessive overpressure inside the intermediate chamber 5-remains very high.

Figure 3D:
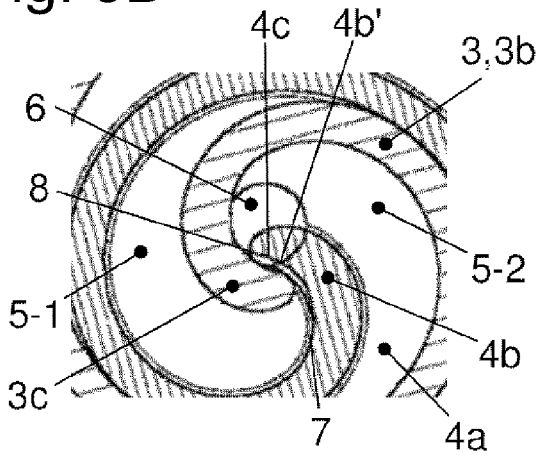

With an arrangement of stator 3 and orbiter 4 at a rotation angle of 60° as per FIG. 3D and construction of the wall according to the invention 4*b*, a gap is opened both in the area of the first section 7 between the intermediate chamber 5-0 and the first end chamber 5-1 and in the area of the second section 8 between the intermediate chamber 5-0 and the second end chamber 5-2 in comparison with the conventional wall 4*b*' in such a way that compressed fluid flows between the end chambers 5-1, 5-2 and that an early pressure equalization is thereby performed in both end chambers 5-1, 5-2. The intermediate chamber 5-0 is a complete component of the flow path between the end chambers 5-1, 5-2, so that the degree of opening between the intermediate chamber 5-0 and the first end chamber 5-1 as per FIG. 4B is zero. As per FIG. 4A, the flow path between the end chambers 5-1, 5-2 exhibits a degree of opening of around 10%.

With the construction of the conventional wall 4*b*', both the first section 7, as a connection between the intermediate chamber 5-0 and the first end chamber 5-1, and the second section 8, as a connection between the intermediate chamber 5-0 and the second end chamber 5-2, are closed, meaning that the flow path between the end chambers 5-1, 5-2 is consequently also closed and additionally that the risk of excessive overpressure inside the intermediate chamber 5-remains very high. The intermediate chamber 5-0 is also reduced to a minimum volume.

With an arrangement of stator 3 and orbiter 4 at rotation angles in excess of 60° as per FIGS. 3E to 3H, particularly at rotation angles of around 85°, 100°, 105° and 115°, and construction of the wall according to the invention 4*b*, the flow path between the end chambers 5-1, 5-2 remains continuously open, meaning that the degree of opening is around 30%, 52%, 80% and 100%. At a rotation angle of 115°, the flow path is completely open. The pressure equalization in both end chambers 5-1, 5-2 is performed continuously and evenly. Due to the lack of an intermediate chamber 5-0, the degree of opening of the flow path between the intermediate chamber 5-0 and the first end chamber 5-1 as per FIG. 4B remains zero.

Figure 3E:
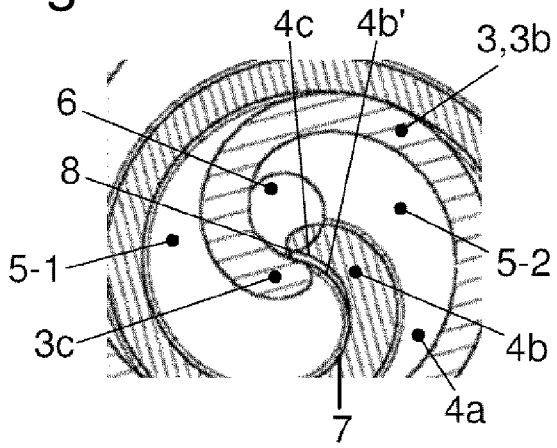
Figure 3F:
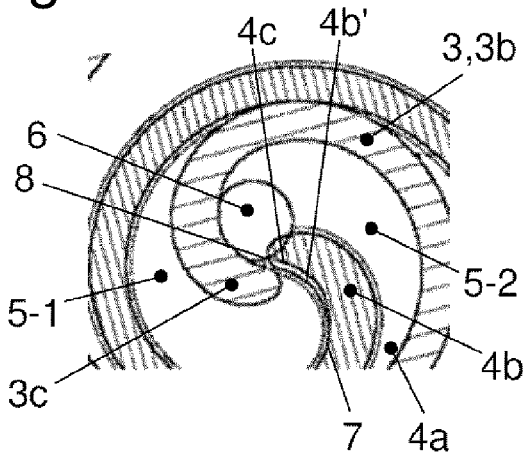
Figure 3G:
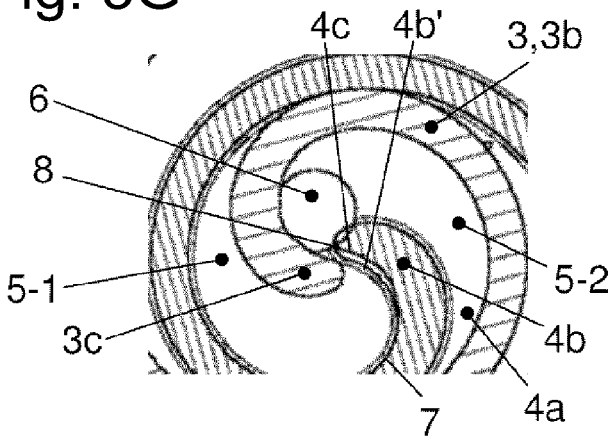
Figure 3H:
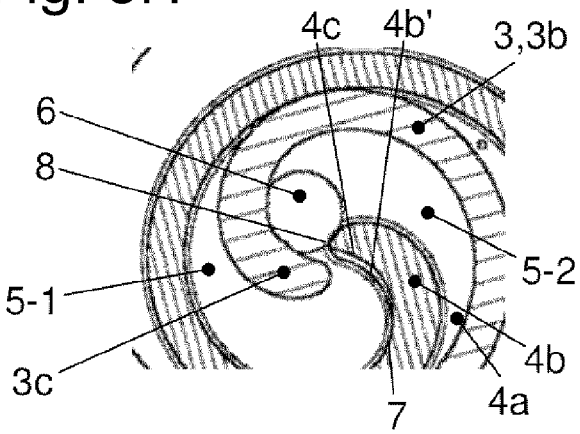

With the construction of the conventional wall 4*b*' and an arrangement of stator 3 and orbiter 4 at a rotation angle of around 85° as per FIG. 3E, the sections 7, 8, as a connection between the end chambers 5-1, 5-2, and consequently also the flow path between the end chambers 5-1, 5-2, remain closed. It is not possible to perform pressure equalization between the end chambers 5-1, 5-2. Only with an arrangement of stator 3 and orbiter 4 at a rotation angle of around 100° as per FIG. 3F is a gap opened as a flow path between the end chambers 5-1, 5-2, meaning that a process of pressure equalization between the end chambers 5-1, 5-2 starts. As per FIG. 4A, the degree of opening of the flow path is around 5%. With an arrangement of stator 3 and orbiter 4 at rotation angles in excess of 100° as per FIGS. 3G and 3H, particularly at rotation angles of around 105° and 115°, the flow path between the end chambers 5-1, 5-2 is opened further, meaning that the degree of opening is then around 40% and 80%. Only at a rotation angle of 120° is the flow path completely open.

When comparing an orbiter 4 with a wall according to the invention 4*b* against an orbiter with a conventional wall 4*b*', in summary it can be stated that the flow path between the end chambers 5-1, 5-2 is already opened evenly, starting at a rotation angle in the range from 30° to 40°, with the inventive embodiment, so that even and continuous pressure equalization takes place between the end chambers 5-1, 5-2. On an orbiter with conventional wall 4*b*', the flow path between the end chambers 5-1, 5-2 is only opened at a rotation angle of around 100°. Since the flow paths are each completely open at a rotation angle of around 115° to 120°, the flow path on the orbiter with conventional wall 4*b*' is opened abruptly and in a short time period, meaning that the pressure equalization also cannot take place evenly or continuously.

In addition to this, an overpressure inside the intermediate chamber 5-0 is reduced or avoided by the opening of a flow path between the intermediate chamber 5-0 and an end chamber 5-1 on the orbiter 4 with a wall according to the invention 4*b*. A flow path of this kind is not opened with an orbiter exhibiting a conventional wall 4*b*', meaning that the overpressure.

The invention claimed is:

1. A scroll compressor for compressing a gaseous fluid comprising:

a non-moving stator with a base plate and a spiral-shaped wall that extends from the base plate;

at least one outlet; and a moving orbiter with a base plate and a spiral-shaped wall that extends from the base plate, wherein the base plate of the stator and the base plate of the orbiter are arranged relative to one another in such a way that the wall of the stator and the wall of the orbiter interlock with one another and create closed working chambers, wherein volumes and positions of the working chambers are changed in reaction to a rotary movement of the orbiter, wherein the wall of the stator and the wall of the orbiter are configured in such a way that a first end chamber of the working chambers and a second end chamber of the working chambers of a compression path, as well as an intermediate chamber arranged between the first end chamber and the second end chamber at inner ends of the wall of the stator and the wall of the orbiter are formed in an area of the at least one outlet based on a rotation angle of the orbiter, and wherein at least one of the wall of the stator and the wall of the orbiter in an area of the inner ends is configured in such a way that a gap is created between the wall of the stator and the wall of the orbiter as a flow path from the intermediate chamber to at least one of the first end chamber and the second end chamber or as a flow path from the first end chamber to the second end chamber based on the rotation angle of the orbiter, wherein a degree of opening of the flow path is dependent on the rotation angle of the orbiter, wherein as the rotation angle of the orbiter increases, the degree of opening of the flow path from the intermediate chamber to the at least one of the first end chamber and the second end chamber increases from 0 to a maximum, and the degree of opening of the flow path from the first end chamber to the second end chamber gradually increases from when the degree of opening of the flow path from the intermediate chamber to the at least one of the first end chamber and the second end chamber is the maximum.

2. The scroll compressor according to claim 1, wherein the wall of the stator with the inner end on the wall of the orbiter and the wall of the orbiter with the inner end on the wall of the stator are arranged next to one another and create the sealed intermediate chamber based on the rotation angle of the orbiter.

3. The scroll compressor according to claim 1, wherein the gap is created, based on the rotation angle of the orbiter, between the wall of the stator and the wall of the orbiter as a flow path from the intermediate chamber to the first end chamber and/or the gap is created as a flow path from the intermediate chamber to the second end chamber, wherein the degree of opening of each of the flow paths is dependent on the rotation angle of the orbiter.

4. The scroll compressor according to claim 1, wherein the at least one of the wall of the stator and the wall of the orbiter is constructed with a wall thickness reduced in the area of the inner ends between two sections in order to increase an original volume of the intermediate chamber.

5. The scroll compressor according to claim 4, wherein the at least one of the wall of the stator and the wall of the orbiter is constructed in such a way that the wall thickness of the at least one of the wall of the stator and the wall of the orbiter decreases continuously from a first one of the two sections moving towards a second one of the two sections and is then increased in an area of the second one of the two sections to an original thickness at the second one of the two sections.

6. The scroll compressor according to claim 1, wherein the at least one of the wall of the stator and the wall of the orbiter exhibits a constant wall thickness across a height of the at least one of the wall of the stator and the wall of the orbiter.

7. The scroll compressor according to claim 1, wherein the wall of the orbiter is constructed in such a way in the area of the inner end that a gap is created between the wall of the stator and the wall of the orbiter as a flow path from the intermediate chamber to the at least one of the first end chamber and the second end chamber.

8. The scroll compressor according to claim 1, wherein the wall of the stator is constructed in such a way in the area of the inner end that a gap is created between the wall of the stator and the wall of the orbiter as a flow path from the intermediate chamber to the at least one of the first end chamber and the second end chamber.

9. A process for compressing the gaseous fluid using the scroll compressor according to claim 1, wherein in a certain range of the rotation angle of the orbiter with an arrangement of the stator and the orbiter a gap is opened between the wall of the stator and the wall of the orbiter as a flow path from the intermediate chamber to the at least one of the first end chamber and the second end chamber, whose degree of opening is dependent on the rotation angle of the orbiter, wherein the intermediate chamber is closed at a rotation angle of 0° with the arrangement of the stator and orbiter.

10. The process according to claim 9, wherein the flow path from the intermediate chamber to the at least one of the first end chamber and the second end chamber is opened in the rotation angle range of greater than 0° up to 60°.

11. The process according to claim 9, wherein an open gap is created between the intermediate chamber and one of the first end chamber and the second end chamber with an arrangement of the stator and the orbiter at the rotation angle of the orbiter in a range around 20°, wherein the flow path between the intermediate chamber and the one of the first end chamber and the second end chamber exhibits a degree of opening of around 20%.

12. The process according to claim 9, wherein an open gap is created between the intermediate chamber and the first end chamber, as well as between the intermediate chamber and the second end chamber, with an arrangement of the stator and the orbiter at the rotation angle of the orbiter in a range around 30°.

13. The process according to claim 12, wherein a flow path between the intermediate chamber and one of the first end chamber and the second end chamber exhibits a degree of opening of around 40%.

14. The process according to claim 9, wherein a gap is created between the intermediate chamber and the first end chamber, as well as between the intermediate chamber and the second end chamber with an arrangement of the stator and the orbiter at the rotation angle of the orbiter in a range around 60° in such a way that compressed fluid flows between the first end chamber and the second end chamber.

15. The process according to claim 9, wherein a flow path between the first end chamber and the second end chamber is continuously opened at the rotation angle within a range greater than 30° and fully open at the rotation angle of around 115° with an arrangement of the stator and the orbiter.

16. A scroll compressor for compressing a gaseous fluid comprising:

a non-moving stator with a base plate and a spiral-shaped wall that extends from the base plate;

at least one outlet; and a moving orbiter with a base plate and a spiral-shaped wall that extends from the base plate, wherein the base plate of the stator and the base plate of the orbiter are arranged relative to one another in such a way that the wall of the stator and the wall of the orbiter interlock with one another and create closed working chambers, wherein volumes and positions of the working chambers are changed in reaction to a rotary movement of the orbiter, wherein the wall of the stator and the wall of the orbiter are configured in such a way that a first end chamber of the working chambers and a second end chamber of the working chambers of a compression path, as well as an intermediate chamber arranged between the first end chamber and the second end chamber at inner ends of the wall of the stator and the wall of the orbiter are formed in an area of the at least one outlet based on a rotation angle of the orbiter, and wherein at least one of the wall of the stator and the wall of the orbiter in an area of the inner ends is configured in such a way that a gap is created between the wall of the stator and the wall of the orbiter as a flow path from the intermediate chamber to at least one of the first end chamber and the second end chamber, wherein a degree of opening of the flow path is dependent on the rotation angle of the orbiter, wherein the at least one of the wall of the stator and the wall of the orbiter is constructed with a wall thickness reduced in the area of the inner ends between two sections in order to increase an original volume of the intermediate chamber, wherein the at least one of the wall of the stator and the wall of the orbiter is constructed in such a way that the wall thickness of the at least one of the wall of the stator and the wall of the orbiter decreases continuously from a first one of the two sections moving towards a second one of the two sections and is then increased in an area of the second one of the two sections to an original thickness at the second one of the two sections.

17. A process for compressing a gaseous fluid using a scroll compressor, the scroll compressor comprising:

a non-moving stator with a base plate and a spiral-shaped wall that extends from the base plate;

at least one outlet; and a moving orbiter with a base plate and a spiral-shaped wall that extends from the base plate, wherein the base plate of the stator and the base plate of the orbiter are arranged relative to one another in such a way that the wall of the stator and the wall of the orbiter interlock with one another and create closed working chambers, wherein volumes and positions of the working chambers are changed in reaction to a rotary movement of the orbiter, wherein the wall of the stator and the wall of the orbiter are configured in such a way that a first end chamber of the working chambers and a second end chamber of the working chambers of a compression path, as well as an intermediate chamber arranged between the first end chamber and the second end chamber at inner ends of the wall of the stator and the wall of the orbiter are formed in an area of the at least one outlet based on a rotation angle of the orbiter, and wherein at least one of the wall of the stator and the wall of the orbiter in an area of the inner ends is configured in such a way that a gap is created between the wall of the stator and the wall of the orbiter as a flow path from the intermediate chamber to at least one of the first end chamber and the second end chamber, wherein a degree of opening of the flow path is dependent on the rotation angle of the orbiter, wherein in a certain range of the rotation angle of the orbiter with an arrangement of the stator and the orbiter a gap is opened between the wall of the stator and the wall of the orbiter as a flow path from the intermediate chamber to the at least one of the first end chamber and the second end chamber, whose degree of opening is dependent on the rotation angle of the orbiter, wherein the intermediate chamber is closed at a rotation angle of 0° with the arrangement of the stator and orbiter.

* * * * *